US010222064B2

(12) United States Patent
Kostka et al.

(10) Patent No.: US 10,222,064 B2
(45) Date of Patent: Mar. 5, 2019

(54) HEAT SHIELD PANELS WITH OVERLAP JOINTS FOR A TURBINE ENGINE COMBUSTOR

(71) Applicant: United Technologies Corporation, Farmington, CT (US)

(72) Inventors: Stanislav Kostka, Shrewsbury, MA (US); Frank J. Cunha, Avon, CT (US)

(73) Assignee: United Technologies Corporation, Farmington, CT (US)

( * ) Notice: Subject to any disclaimer, the term of this patent is extended or adjusted under 35 U.S.C. 154(b) by 96 days.

(21) Appl. No.: 15/025,631

(22) PCT Filed: Sep. 30, 2014

(86) PCT No.: PCT/US2014/058349

§ 371 (c)(1),
(2) Date: Mar. 29, 2016

(87) PCT Pub. No.: WO2015/050879

PCT Pub. Date: Apr. 9, 2015

(65) Prior Publication Data

US 2016/0230996 A1 Aug. 11, 2016

Related U.S. Application Data

(60) Provisional application No. 61/887,016, filed on Oct. 4, 2013.

(51) Int. Cl.
*F23R 3/00* (2006.01)
*F23R 3/06* (2006.01)
(Continued)

(52) U.S. Cl.
CPC ..... *F23R 3/002* (2013.01); *F23M 5/00* (2013.01); *F23M 5/04* (2013.01); *F23M 5/085* (2013.01);
(Continued)

(58) Field of Classification Search
CPC . F23M 5/00; F23M 5/04; F23M 5/085; F23R 3/002; F23R 3/005; F23R 3/007;
(Continued)

(56) References Cited

U.S. PATENT DOCUMENTS 3,038,309 A * 6/1962 Waters ..... F23R 3/002 60/757
4,109,459 A 8/1978 Ekstedt et al.
(Continued)

FOREIGN PATENT DOCUMENTS

GB 2298266 A * 8/1996 ..... F23R 3/002

OTHER PUBLICATIONS

Extended EP Search Report dated Oct. 7, 2016.

*Primary Examiner* — Scott Walthour
(74) *Attorney, Agent, or Firm* — O'Shea Getz P.C.

(57) ABSTRACT

A combustor wall is provided for a turbine engine. The combustor wall includes a combustor shell and a combustor heat shield that is attached to the shell. The heat shield includes a first panel and a second panel that sealingly engages the first panel in an overlap joint. A cooling cavity extends between the shell and the heat shield and fluidly couples a plurality of apertures in the shell with a plurality of apertures in the heat shield.

16 Claims, 7 Drawing Sheets

(51) Int. Cl.

| | |
|---|---|
| ***F23M 5/08*** | (2006.01) |
| ***F23M 5/00*** | (2006.01) |
| ***F23R 3/08*** | (2006.01) |
| ***F23M 5/04*** | (2006.01) |
| ***F23R 3/60*** | (2006.01) |

(52) U.S. Cl.
CPC ..... *F23R 3/005* (2013.01); *F23R 3/007* (2013.01); *F23R 3/06* (2013.01); *F23R 3/08* (2013.01); *F23R 3/60* (2013.01); *F23R 2900/00012* (2013.01); *F23R 2900/00017* (2013.01); *F23R 2900/03041* (2013.01); *F23R 2900/03042* (2013.01); *F23R 2900/03044* (2013.01); *F23R 2900/03045* (2013.01)

(58) Field of Classification Search
CPC ..... F23R 3/06; F23R 3/08; F23R 3/60; F23R 2900/00012; F23R 2900/03041; F23R 2900/03042; F23R 2900/03044; F23R 2900/03045; F23R 2900/00017
See application file for complete search history.

(56) References Cited

U.S. PATENT DOCUMENTS

| | | | | |
|---|---|---|---|---|
| 4,253,301 | A | 3/1981 | Vogt | |
| 4,446,693 | A | 5/1984 | Pidcock et al. | |
| 4,498,288 | A * | 2/1985 | Vogt | F23R 3/002 60/733 |
| 4,614,082 | A | 9/1986 | Sterman et al. | |
| 4,688,310 | A * | 8/1987 | Kelm | B21D 35/00 29/889.22 |
| 4,912,922 | A | 4/1990 | Maclin | |
| 5,079,915 | A | 1/1992 | Veau | |
| 5,461,866 | A | 10/1995 | Sullivan et al. | |
| 5,799,491 | A | 9/1998 | Bell et al. | |
| 6,029,455 | A | 2/2000 | Sandelis | |
| 6,240,731 | B1 | 6/2001 | Hoke et al. | |
| 6,408,628 | B1 * | 6/2002 | Pidcock | F23R 3/002 60/752 |
| 6,412,272 | B1 | 7/2002 | Titterton, III et al. | |
| 7,093,439 | B2 | 8/2006 | Pacheco-Tougas et al. | |
| 7,942,004 | B2 | 5/2011 | Hodder | |
| 7,954,325 | B2 | 6/2011 | Burd et al. | |
| 8,443,610 | B2 | 5/2013 | Hoke et al. | |
| 8,479,521 | B2 | 7/2013 | Hoke | |
| 2001/0029738 | A1 * | 10/2001 | Pidcock | F23R 3/002 60/754 |
| 2005/0022531 | A1 | 2/2005 | Burd | |
| 2005/0034399 | A1 * | 2/2005 | Pidcock | F23R 3/002 52/506.1 |
| 2006/0117755 | A1 | 6/2006 | Spooner et al. | |
| 2006/0179770 | A1 * | 8/2006 | Hodder | F23M 5/02 52/588.1 |
| 2007/0044935 | A1 | 3/2007 | Memmen | |
| 2007/0283700 | A1 * | 12/2007 | Gerendas | F23R 3/002 60/754 |
| 2010/0095679 | A1 * | 4/2010 | Rudrapatna | F23R 3/005 60/752 |

* cited by examiner

HEAT SHIELD PANELS WITH OVERLAP JOINTS FOR A TURBINE ENGINE COMBUSTOR

CROSS-REFERENCE TO RELATED APPLICATIONS

This application claims priority to PCT Patent Application No. PCT/US14/058349 filed Sep. 30, 2014, which claims priority to U.S. Provisional Application Ser. No. 61/887,016 filed Oct. 4, 2013, which are hereby incorporated herein by reference in their entireties.

BACKGROUND OF THE INVENTION

1. Technical Field

This disclosure relates generally to a turbine engine and, more particularly, to a combustor for a turbine engine.

2. Background Information

A floating wall combustor for a turbine engine typically includes a bulkhead that extends radially between inner and outer combustor walls. Each of the combustor walls includes a shell and a heat shield, which defines a radial side of a combustion chamber. Cooling cavities extend radially between the heat shield and the shell. The cooling cavities are fluidly coupled with impingement apertures in the shell and effusion apertures in the heat shield.

The heat shield is formed from a plurality of heat shield panels. The arrangement and configuration of the heat shield panels may provide multiple leakage paths for cooling air to leak from the cooling cavities and into the combustion chamber. In addition, air may stagnate within channels between adjacent heat shield panels, thereby subjecting edges of the panels to relatively high temperatures.

There is a need in the art for an improved turbine engine combustor.

SUMMARY OF THE DISCLOSURE

According to an aspect of the invention, a combustor wall is provided for a turbine engine. The combustor wall includes a combustor shell and a combustor heat shield that is attached to the shell. The heat shield includes a first panel and a second panel that sealingly engages the first panel in an overlap joint. A cooling cavity extends between the shell and the heat shield. The cooling cavity fluidly couples a plurality of apertures in the shell with a plurality of apertures in the heat shield.

According to another aspect of the invention, another combustor is provided for a turbine engine. The combustor includes a tubular combustor shell that extends along an axis. The combustor also includes a heat shield first panel that is attached to the shell, and a heat shield second panel that is sealingly engaged with the first panel in an overlap joint. A portion of the second panel is radially between the shell and the first panel. A cooling cavity fluidly couples a plurality of apertures in the shell with a plurality of apertures in the first panel.

According to another aspect of the invention, another combustor is provided for a turbine engine. The combustor includes a combustor shell that extends along an axis. The combustor also includes a heat shield first panel that is attached to the shell, and a heat shield second panel that is sealingly engaged with and contacts the first panel. The shell, the first panel and the second panel at least partially form a cooling cavity. The cooling cavity fluidly couples a plurality of apertures in the shell with a plurality of apertures in the first panel.

The combustor may also include a combustor first wall, a combustor second wall and a combustor bulkhead. The bulkhead may extend radially between the first wall and the second wall. The first wall, the second wall and the bulkhead may form a combustion chamber.

The second wall may include the shell and the heat shield. For example, the second wall may include the shell, the first panel and the second panel. Alternatively, the second wall may include the shell and the first panel, and the bulkhead may include the second panel.

The bulkhead may also include an annular shell. The second panel may be attached to the annular shell. The cooling cavity may extend axially between the annular shell and the second panel.

The combustor may also include an annular combustor second shell that is attached to the shell. The second panel may include a rail that extends towards the second shell and forms a portion of the overlap joint.

The overlap joint may be configured as a joggle lap joint or a double joggle lap joint.

The second panel may be mechanically biased against the first panel at the overlap joint.

The second panel may include a rail that is located at the overlap joint and extends to the shell.

The second panel may include one or more cooling features that are located at the overlap joint within the cooling cavity. One or more of the apertures in the shell may direct cooling air into the cooling cavity to impinge against one or more of the cooling features. A first of the cooling features may be configured as or otherwise include a cooling pin.

The heat shield may extend along an axis. An axial end of the first panel may engage an axial end of the second panel at the overlap joint. Alternatively, a circumferential end of the first panel may engage a circumferential end of the second panel at the overlap joint. The first and/or the second panels may also be arcuate shaped.

The cooling cavity may extend from the first panel and the second panel to the shell. Alternatively, the cooling cavity may extend from the first panel to the shell. A second cooling cavity may extend from the second panel to the shell. The second cooling cavity may also be separated from the cooling cavity by a rail.

A channel may be formed between the first panel and the second panel at the overlap joint. One or more of the apertures in the heat shield may extend through the second panel between the cooling cavity and the channel.

The shell may be configured and adapted to engage a combustor bulkhead at an upstream end thereof.

The foregoing features and the operation of the invention will become more apparent in light of the following description and the accompanying drawings.

DETAILED DESCRIPTION OF THE INVENTION

Figure 1:
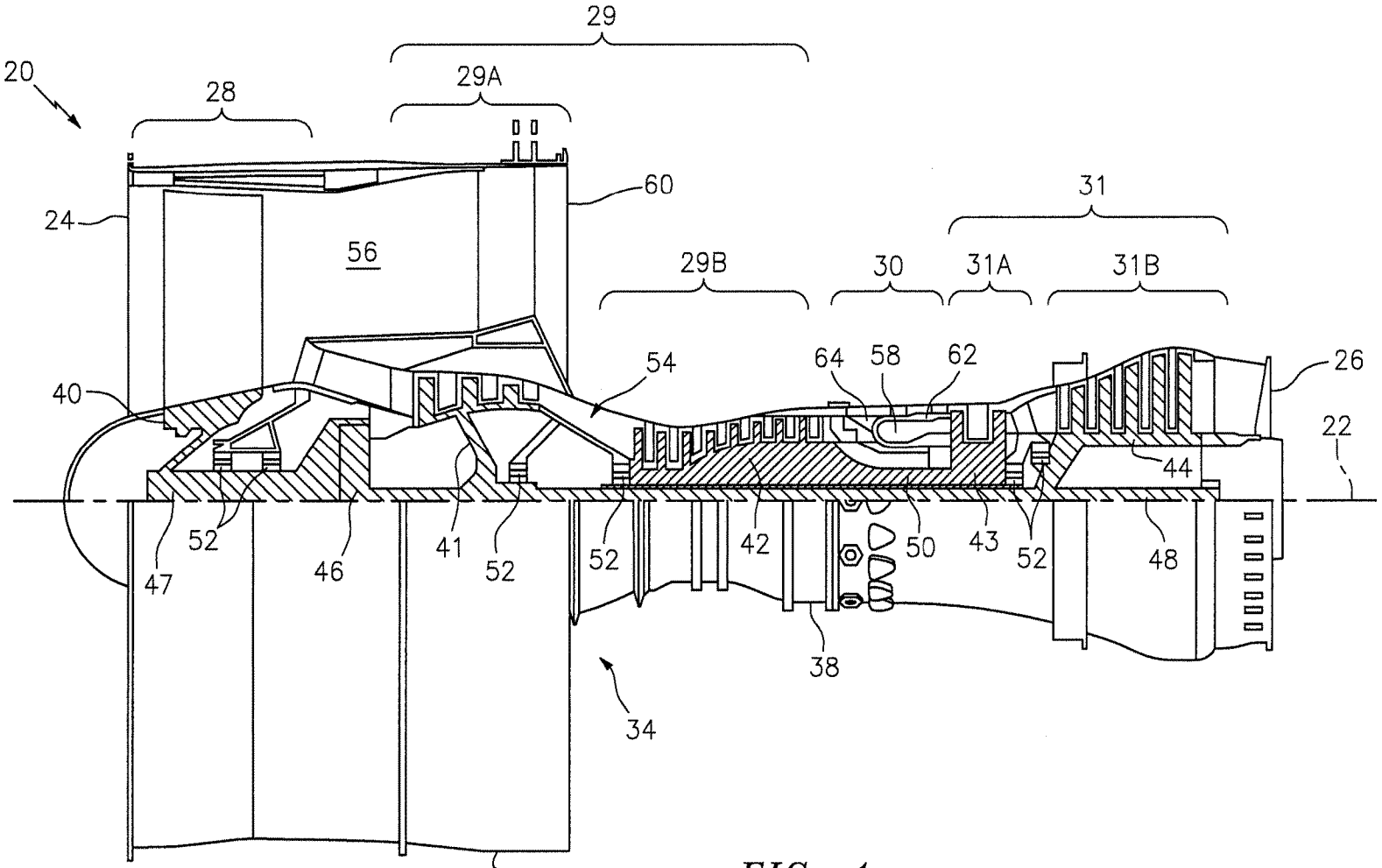
FIG. 1 is a side cutaway illustration of a geared turbine engine.

FIG. 1 is a side cutaway illustration of a geared turbine engine 20. This engine 20 extends along an axis 22 between an upstream airflow inlet 24 and a downstream airflow exhaust 26. The engine 20 includes a fan section 28, a compressor section 29, a combustor section 30 and a turbine section 31. The compressor section 29 includes a low pressure compressor (LPC) section 29A and a high pressure compressor (HPC) section 29B. The turbine section 31 includes a high pressure turbine (HPT) section 31A and a low pressure turbine (LPT) section 31B. The engine sections 28-31 are arranged sequentially along the axis 22 within an engine housing 34, which includes a first engine case 36 (e.g., a fan nacelle) and a second engine case 38 (e.g., a core nacelle).

Each of the engine sections 28, 29A, 29B, 31A and 31B includes a respective rotor 40-44. Each of the rotors 40-44 includes a plurality of rotor blades arranged circumferentially around and connected to (e.g., formed integral with or mechanically fastened, welded, brazed, adhered or otherwise attached to) one or more respective rotor disks. The fan rotor 40 is connected to a gear train 46 (e.g., an epicyclic gear train) through a shaft 47. The gear train 46 and the LPC rotor 41 are connected to and driven by the LPT rotor 44 through a low speed shaft 48. The HPC rotor 42 is connected to and driven by the HPT rotor 43 through a high speed shaft 50. The shafts 47, 48 and 50 are rotatably supported by a plurality of bearings 52. Each of the bearings 52 is connected to the second engine case 38 by at least one stator such as, for example, an annular support strut.

Air enters the engine 20 through the airflow inlet 24, and is directed through the fan section 28 and into an annular core gas path 54 and an annular bypass gas path 56. The air within the core gas path 54 may be referred to as "core air". The air within the bypass gas path 56 may be referred to as "bypass air".

The core air is directed through the engine sections 29-31 and exits the engine 20 through the airflow exhaust 26. Within the combustor section 30, fuel is injected into an annular combustion chamber 58 and mixed with the core air. This fuel-core air mixture is ignited to power the engine 20 and provide forward engine thrust. The bypass air is directed through the bypass gas path 56 and out of the engine 20 through a bypass nozzle 60 to provide additional forward engine thrust. Alternatively, the bypass air may be directed out of the engine 20 through a thrust reverser to provide reverse engine thrust.

Figure 2:
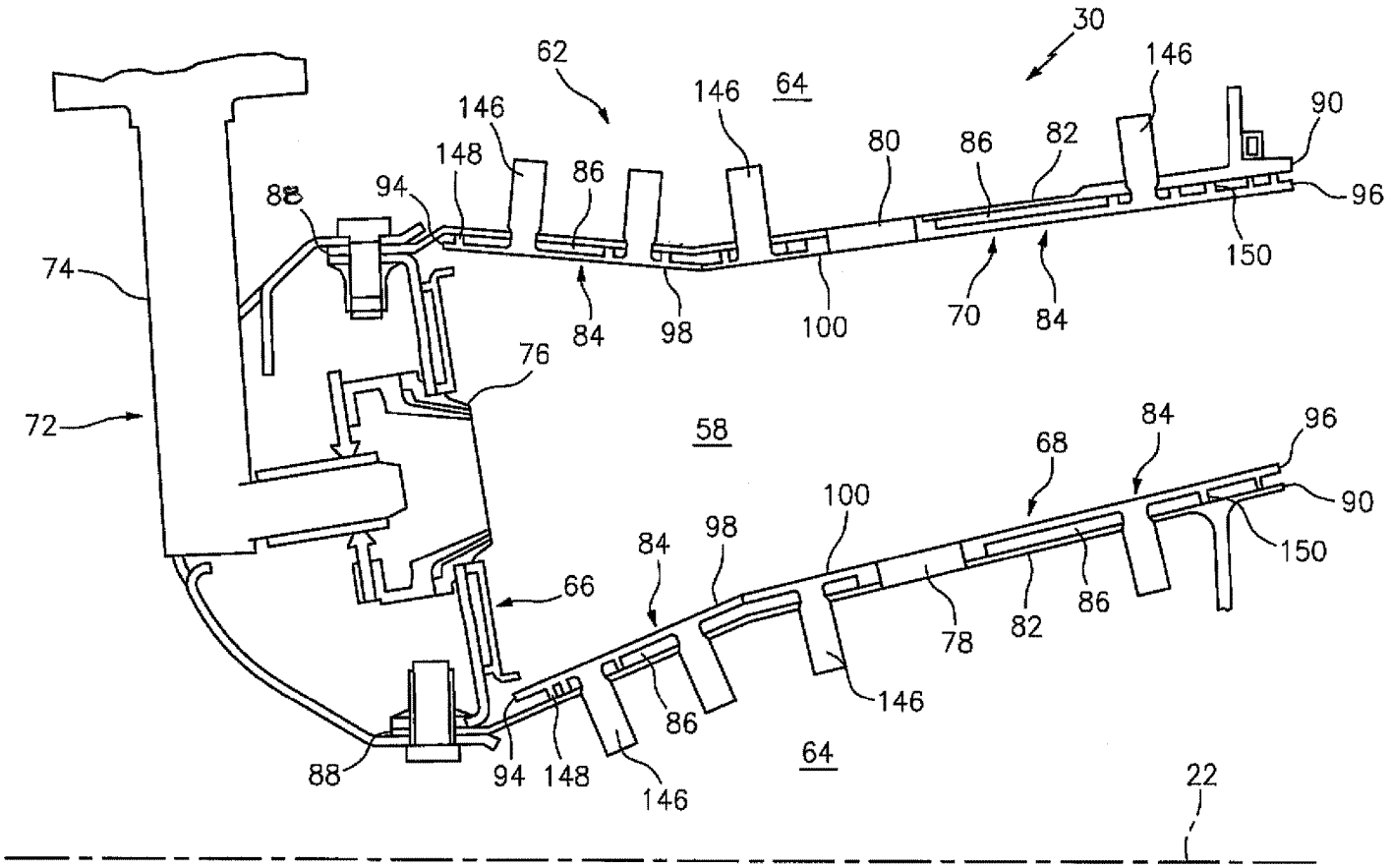
FIG. 2 is a side sectional illustration of a portion of a combustor section.
Figure 3:
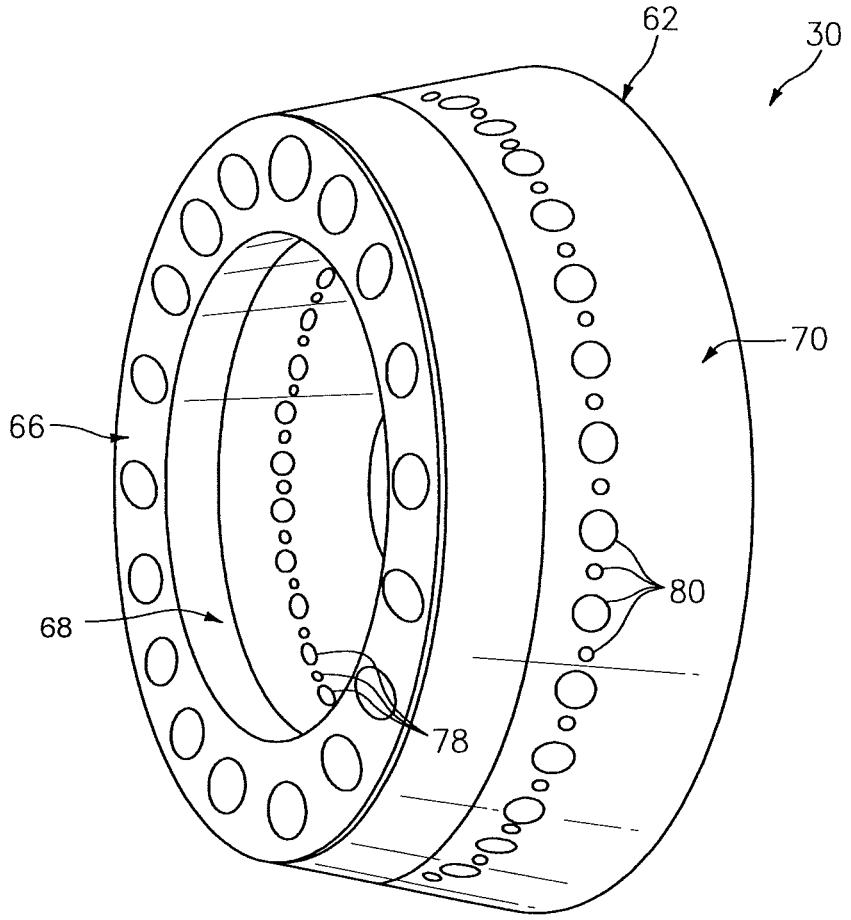
FIG. 3 is a perspective illustration of a portion of a combustor.

Referring to FIGS. 2 and 3, the combustor section 30 includes a combustor 62 arranged within an annular plenum 64. This plenum 64 receives compressed core air from the compressor section 29 (see FIG. 1), and provides the core air to the combustor 62 as described below in further detail.

The combustor 62 includes an annular combustor bulkhead 66, a tubular combustor inner wall 68, a tubular combustor outer wall 70, and a plurality of fuel injector assemblies 72. The bulkhead 66 extends radially between and is connected to the inner wall 68 and the outer wall 70. The inner wall 68 and the outer wall 70 each extends axially along the axis 22 from the bulkhead 66 towards the turbine section 31 (see FIG. 1), thereby defining the combustion chamber 58. The fuel injector assemblies 72 are disposed around the axis 22, and mated with the bulkhead 66. Each of the fuel injector assemblies 72 includes a fuel injector 74 mated with a swirler 76. The fuel injector 74 injects the fuel into the combustion chamber 58. The swirler 76 directs some of the core air from the plenum 64 into the combustion chamber 58 in a manner that facilitates mixing the core air with the injected fuel. Quench apertures 78 and 80 in the inner and/or the outer walls 68 and 70 direct additional core air into the combustion chamber 58 for combustion.

Referring to FIG. 2, the inner wall 68 and the outer wall 70 may each have a multi-walled structure; e.g., a hollow dual-walled structure. The inner wall 68 and the outer wall 70 of FIG. 2, for example, each includes a tubular combustor shell 82, a tubular combustor heat shield 84, and at least one cooling cavity 86 (e.g., impingement cavity).

Figure 4:
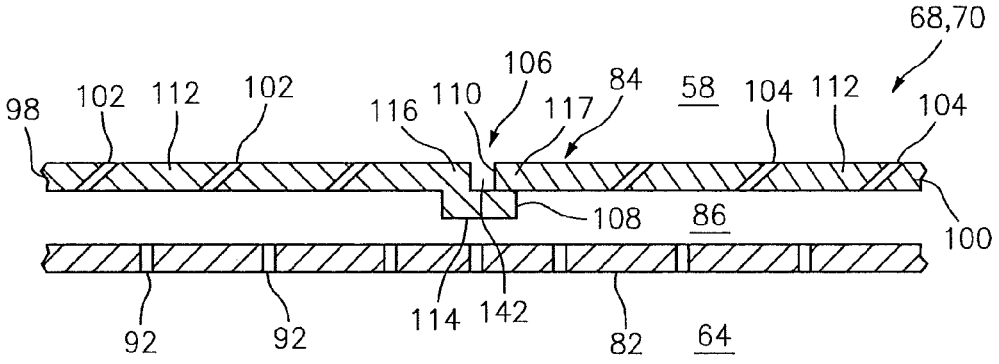
FIG. 4 is a side sectional illustration of a portion of a combustor wall.

The shell 82 extends axially along the axis 22 between an upstream end 88 and a downstream end 90. The shell 82 is connected to the bulkhead 66 at the upstream end 88. The shell 82 may be respectively connected to a case or a stator vane assembly of the HPT section 31A (see FIG. 1) at the downstream end 90. Referring to FIG. 4, the shell 82 includes one or more cooling apertures 92. One or more of these cooling apertures 92 may be configured as impingement apertures, which direct air from the plenum 64 into the cooling cavity 86 to impinge against and cool the heat shield 84.

Referring to FIG. 2, the heat shield 84 extends axially along the axis 22 between an upstream end 94 and a downstream end 96. The heat shield 84 includes a plurality of heat shield panels 98 and 100. Referring to FIG. 4, each of these panels 98, 100 may include one or more cooling apertures 102, 104, respectively. One or more of these cooling apertures 102 and 104 may be configured as effusion apertures, which direct air from the cooling cavity 86 into the combustion chamber 58 to film cool the heat shield 84.

Referring to FIG. 2, the panels 98 are located upstream of the panels 100. The panels 98 are arranged around the axis 22 forming an upstream hoop. The panels 100 are also arranged around the axis 22 forming a downstream hoop.

Referring to FIG. 4, in accordance with exemplary embodiments of the present disclosure, one or more of the panels 98 each sealingly engages an adjacent one of the panels 100 in an overlap joint 106; e.g., a joggle lap joint. Each of the panels 98, for example, extends axially along the axis 22 to an axial end 108; e.g., a downstream end. Each of the panels 100 extends axially along the axis to an axial end 110; e.g., an upstream end. Each of the panels 98 and 100 includes a panel base 112. The panel base 112 may be configured as a generally curved (e.g., arcuate) plate, which extends axially along and circumferentially around the axis. Each of the panels 98 may also include an axial flange 114. The flange 114 is connected to (e.g., integrally formed with, fixed to, or detachably engaged with) and extends circumferentially along an axial edge 116 of the panel base 112 at (e.g., on, adjacent or proximate) the axial end 108. The flange 114 contacts and/or may be mechanically biased radially against an axial edge 117 of a panel base of an adjacent one of the panels 100. The mechanical bias may be achieved by setting (e.g., radial) heights between each panel 98, 100 and the shell 82 with one or more attachments 146 as discussed below in further detail. In this manner, the flange 114 may substantially seal an axially extending gap between the respective panels 98 and 100.

Figure 5:
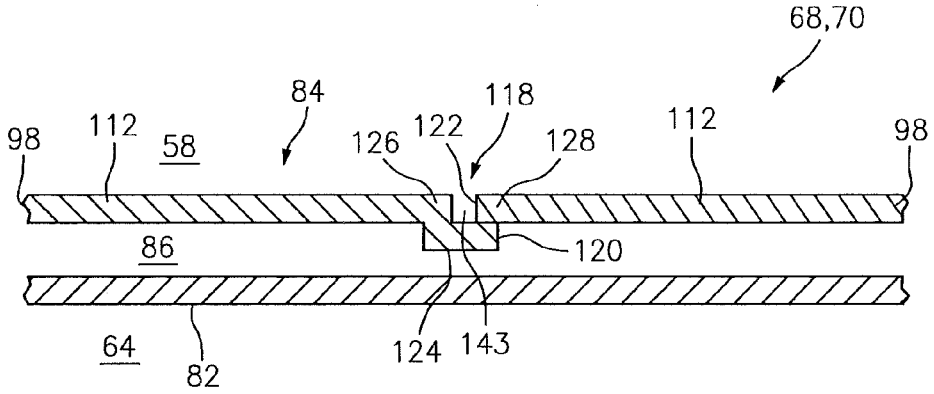
FIG. 5 is a cross sectional illustration of another portion of the combustor wall.

Referring to FIG. 5, one or more of the panels 98 each sealingly engages an adjacent one of the panels 98 in an overlap joint 118; e.g., a joggle lap joint. Each of the panels 98, for example, extends circumferentially around the axis between opposing circumferential ends 120 and 122. Each of the panels 98 may include a circumferential flange 124. The flange 124 is connected to and extends axially along a circumferential edge 126 of the panel base 112 at the circumferential end 120. The flange 124 contacts and/or may be mechanically biased radially against a circumferential edge 128 of the panel base 112 of an adjacent one of the panels 98. In this manner, the flange 124 may substantially seal a circumferentially extending gap between the respective panels 98.

Figure 6:
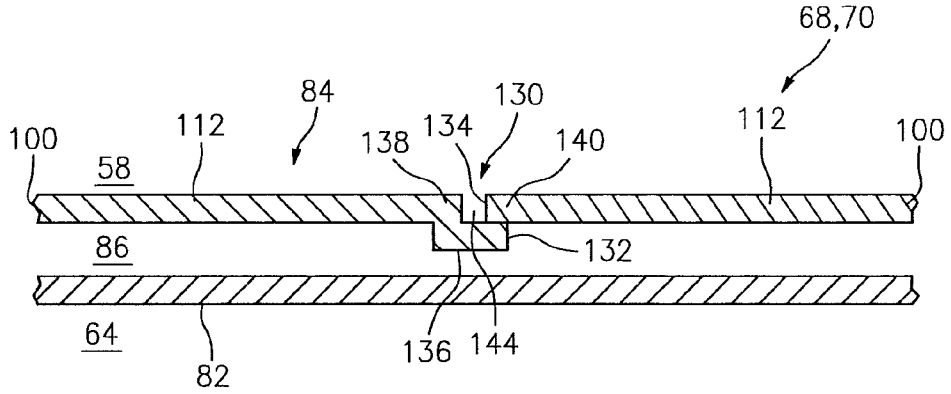
FIG. 6 is a cross sectional illustration of another portion of the combustor wall.

Referring to FIG. 6, one or more of the panels 100 each sealingly engages an adjacent one of the panels 100 in an overlap joint 130; e.g., a joggle lap joint. Each of the panels 100, for example, extends circumferentially around the axis between opposing circumferential ends 132 and 134. Each of the panels 100 may include a circumferential flange 136. The flange 136 is connected to and extends axially along a circumferential edge 138 of the panel base 100 at the circumferential end 132. The flange 136 contacts and/or may be mechanically biased radially against a circumferential edge 140 of the panel base 112 of an adjacent one of the panels 100. In this manner, the flange 136 may substantially seal a circumferentially extending gap between the respective panels 100.

Figure 7:
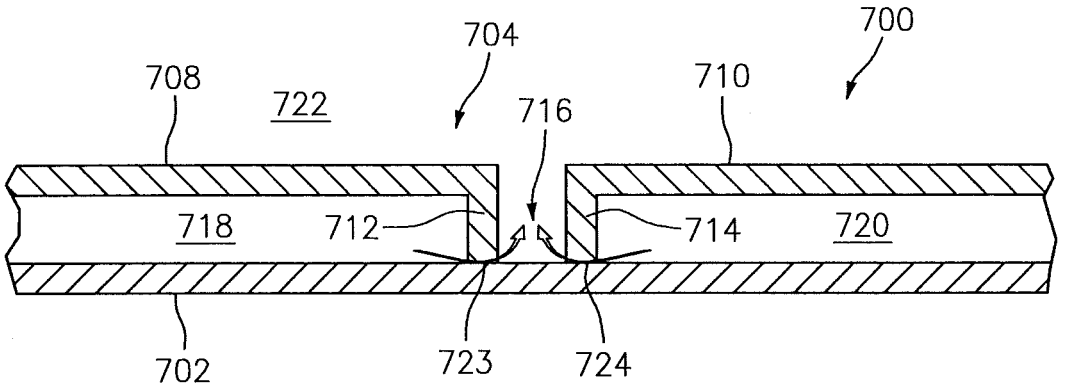
FIG. 7 (PRIOR ART)
FIG. 7 is a side sectional illustration of a portion of a prior art combustor wall.

FIG. 7 illustrates a prior art combustor wall 700 with a shell 702 and a heat shield 704. The heat shield 704 includes a first panel 708 and a second panel 710. The first panel 708 includes a rail 712 that extends radially to the shell 702. The second panel 710 also includes a rail 714 that extends radially to the shell 702. A channel 716 extends between the rails 712 and 714 and the panels 708 and 710 to allow for thermal growth and distortion of the panels 708 and 710. In this combustor wall 700 configuration, air may leak from cooling cavities 718 and 720 and into a combustion chamber 722 along two different paths 723 and 724 through the channel 716. In addition, air may stagnate within the channel 716 under certain conditions. This stagnant air may subject the rails 712 and 714 to relatively high temperatures and decrease the longevity of the panels 708 and 710.

In contrast to the combustor wall 700 of FIG. 7, each of the overlap joints 106, 118 and 130 of FIGS. 4-6 provides a single potential leakage path (e.g., between the respective flange 114, 124, 136 and the panel base 112) from the cooling cavity 86 and into the combustion chamber 58. The overlap joints 106, 118 and 130 therefore may reduce air leakage into the combustion chamber 58 and thereby increase engine 20 efficiency and performance. In addition, a respective channel 142-144 defined between the panel bases 112 may have a smaller cross-section than that of the channel 716 of FIG. 7; e.g., a radial height of the channel 142-144 may be less than a radial height of the channel 716. The overlap joints 106, 118 and 130 therefore may reduce the volume of air that can stagnate between the panels 98 and 100 and increase heat shield 84 durability.

Referring to FIG. 2, the heat shield 84 of the inner wall 68 circumscribes the shell 82 of the inner wall 68, and defines a radially inner side of the combustion chamber 58. The heat shield 84 of the outer wall 70 is arranged radially within the shell 82 of the outer wall 70, and defines a radially outer side of the combustion chamber 58 opposite the radially inner side.

The heat shield 84 and, more particularly, each of the panels 98 and 100 are attached to the shell 82 by a plurality of mechanical attachments 146 (e.g., threaded studs), thereby defining the cooling cavity 86 in each wall 68, 70. This cooling cavity 86 extends radially between the shell 82 and the panels 98 and 100. The cooling cavity 86 extends circumferentially around the axis 22. The cooling cavity 86 extends axially between rails 148 of the panels 98 and rails 150 of the panels 100. It is worth noting FIG. 2 illustrates protrusions (e.g., pins, bosses, etc.) located axially between the rails 148 and the rails 150. These protrusion may be discrete and, thus, do not subdivide the cavity 86. The inner wall 68 and/or the outer wall 70, of course, may each include one or more additional cooling cavities where, for example, (i) one or more of the panels 98, 100 are not sealingly engaged with an adjacent panel 98, 100 and/or (ii) one or more of the panels 98, 100 include one or more additional axially and/or circumferentially extending rails (or flow buffers) as described below.

One or more of the panels 98 and 100 and/or overlap joints 106, 118 and 130 may have configurations other than those described above. Examples of such configurations are described below with reference to the panels 98 and 100 and the overlap joints 106. It should be noted, however, that one or more of the panels 98, 100 and/or the overlap joints 118 and 130 may also or alternatively be configured in a similar manner. In addition, the panels 98, 100 of the inner wall 68 may have different configurations than the panels 98, 100 of the outer wall 70.

Figure 8:
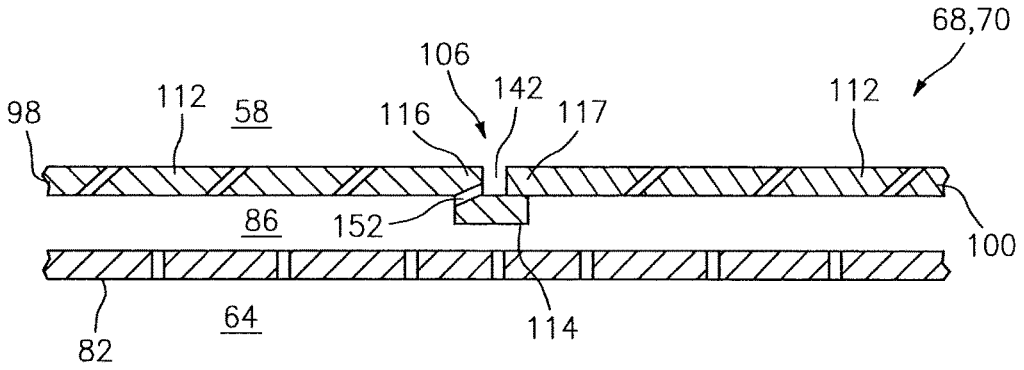
FIG. 8 is a side sectional illustration of a portion of an alternate embodiment combustor wall.

Referring to FIG. 8, the channel 142 may extend between the panel bases 112 of adjacent panels 98 and 100. As indicated above, air may stagnate within the channel 142 under certain conditions subjecting the edges 116 and 117 of the panel bases 112 to relatively high temperatures. In the embodiment of FIG. 8, the panel 98 includes one or more cooling apertures 152. These cooling apertures 152 are adapted to cool the edges 116 and 117 and reduce or prevent air stagnation within the channel 142. Each of the cooling apertures 152 may extend through the panel 98 (e.g., between the panel base 112 and the flange 114) in a manner that directs air from the cooling cavity 86 into the channel 142. Each cooling aperture 152 may be defined in the panel base 112 and/or the flange 114. The cooling channels 152 may be arranged circumferentially around the axis.

Figure 9:
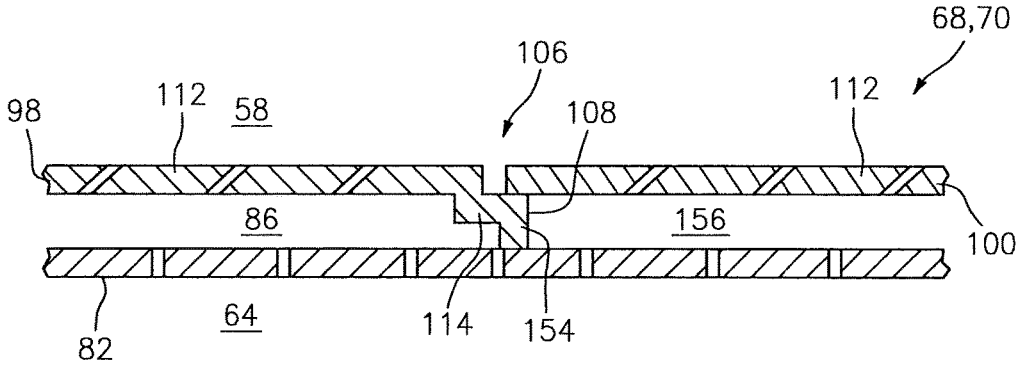
FIG. 9 is a side sectional illustration of a portion of another alternate embodiment combustor wall.

In some embodiments, the inner and/or the outer wall 68, 70 may include more than one cooling cavity as described above. Referring to FIG. 9, for example, one or more of the panels 98 each includes a circumferentially extending rail 154. This rail 154 is located at the axial end 108, and extends from the flange 114 to the respective shell 82. In this manner, the cooling cavity 86 extends radially between the panel 98 and the respective shell 82 and a second cooling cavity 156 extends from the panel 100 to the respective shell 82. Of course, one or more of the panels 98, 100 may also or alternatively each include an axially extending rail that extends from the flange 124, 136 to the respective shell 82. In this manner, the heat shield 84 may be configured with a plurality of circumferentially and/or axially distributed cooling zones.

Figure 10:
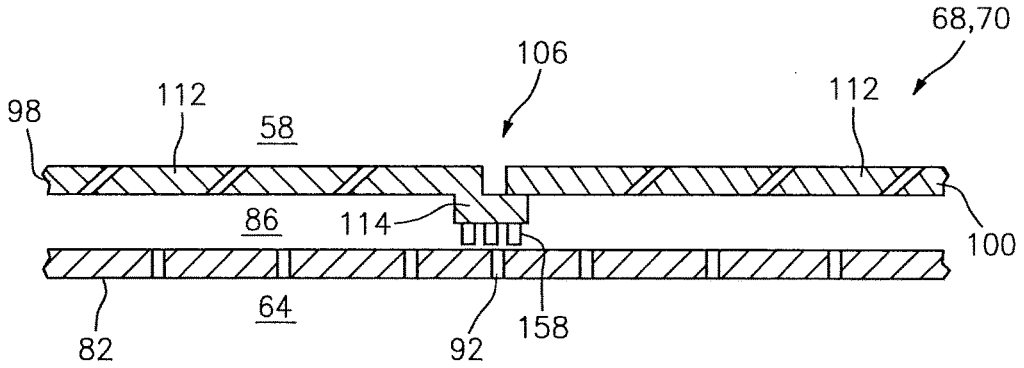
FIG. 10 is a side sectional illustration of a portion of another alternate embodiment combustor wall.

Referring to FIG. 10, in some embodiments, one or more of the panels 98 each includes one or more cooling features 158. Each of the cooling features 158 of FIG. 10 is configured as a cooling pin. However, one or more of the cooling features 158 may alternatively be configured as a pedestal, a dimple, a chevron shaped protrusion, a diamond shaped protrusion, or any other type of protrusion or device that aids in the cooling of the panel. Referring again to the embodiment of FIG. 10, the cooling features 158 are arranged circumferentially around and/or axially along the axis. Each of the cooling features 158 extends radially into the cooling cavity 86 from the flange 114. One or more of the cooling apertures 92 may be configured to direct air from the plenum 64 into the cooling cavity 86 to impinge against one or more of the cooling features 158.

One or more of the panels 98, 100, of course, may also or alternatively include one or more cooling features arranged axially along and/or circumferentially around the axis on the flange 124, 136. In addition, one or more of the cooling features 158 may alternatively extend radially to the respective shell 82.

Figure 11:
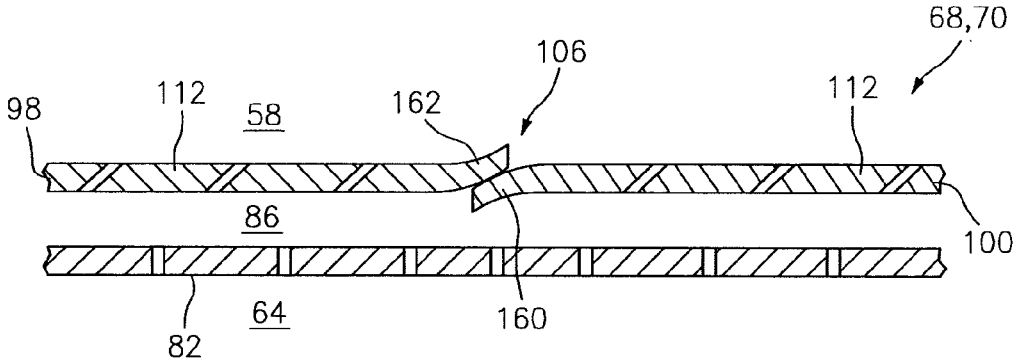
FIG. 11 is a side sectional illustration of a portion of another alternate embodiment combustor wall.
Figure 12:
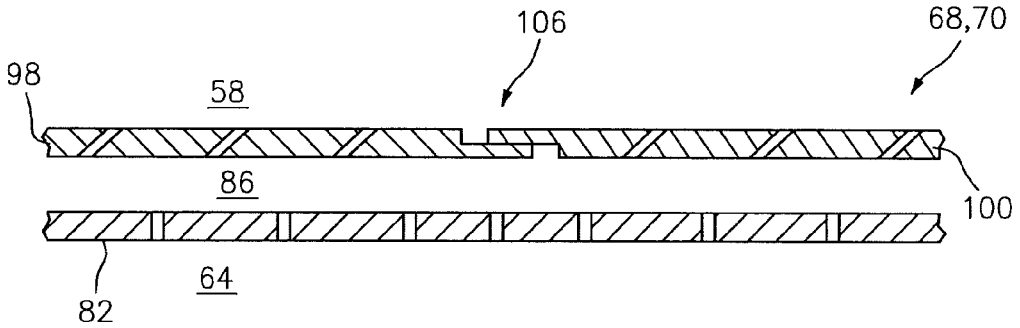
FIG. 12 is a side sectional illustration of a portion of another alternate embodiment combustor wall.
Figure 13:
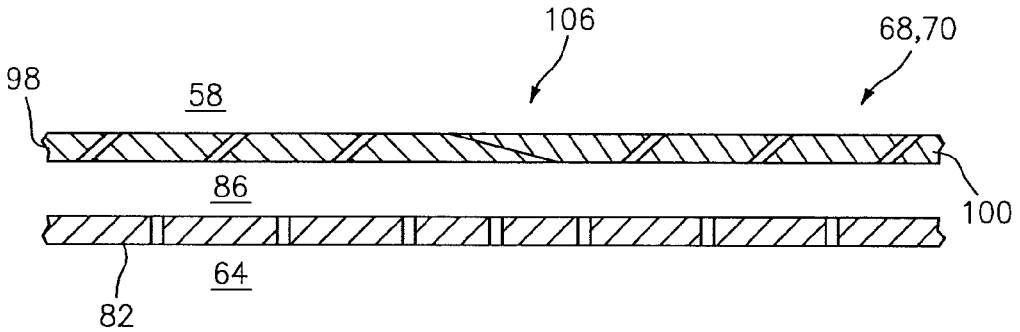
FIG. 13 is a side sectional illustration of a portion of another alternate embodiment combustor wall.

Referring to FIG. 11, in some embodiments, one or more of the overlap joints 106, 118 and 130 (e.g., the overlap joint 106) may each be configured as a (e.g., curved) double joggle lap joint. An end portion 160 of each panel 100, for example, may curve into the cooling cavity 86. An end portion 162 of each panel 98 may curve into the combustion chamber 58. A combustion side of the end portion 160 may contact and/or be mechanically biased against a cooling side of the end portion 162 thereby forming a seal between the panels 98 and 100. Alternatively, one or more of the overlap joints 106, 118 and 130 (e.g., the overlap joint 106) may each be configured as a lap joint as illustrated in FIG. 12, a scarf joint as illustrated in FIG. 13, or any other type of joint in which one panel overlaps another panel and forms a seal therebetween.

Figure 14:
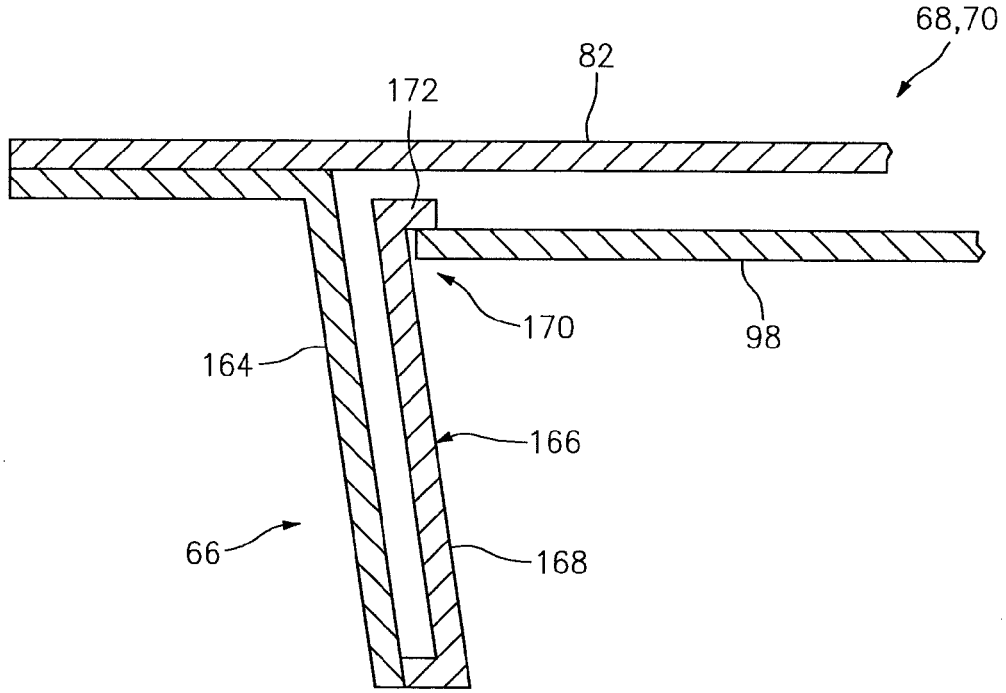
FIG. 14 is a side sectional illustration of a portion of a combustor bulkhead and a combustor wall.
Figure 15:
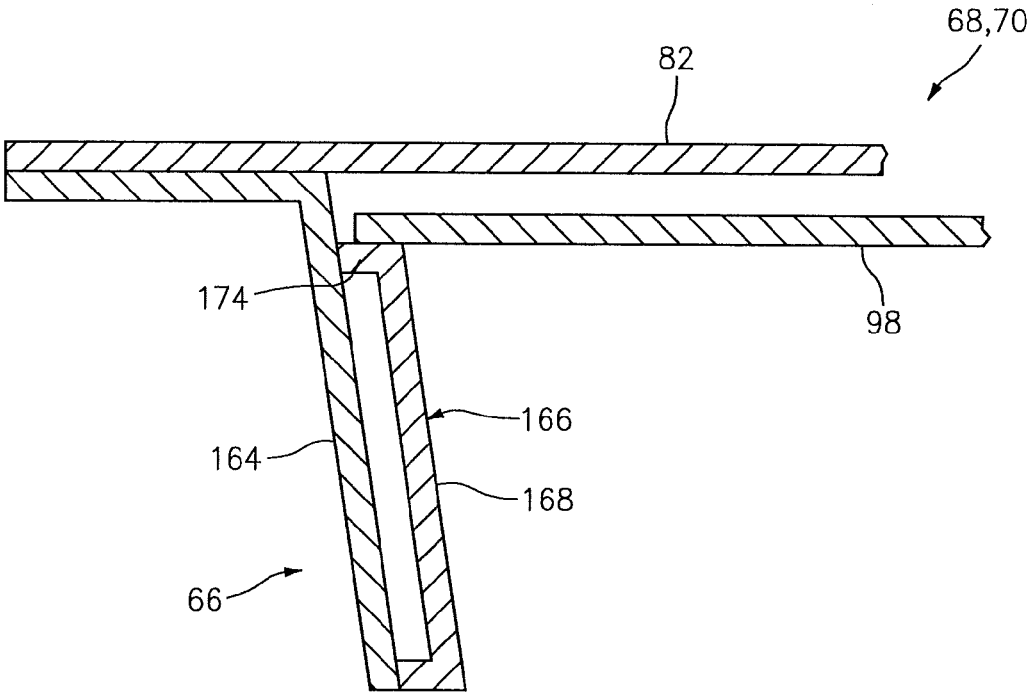
FIG. 15 is a side sectional illustration of a portion of an alternate embodiment combustor bulkhead and combustor wall.

Referring to FIG. 14, in some embodiments, the bulkhead 66 may also be configured with a multi-walled structure; e.g., a hollow dual-walled structure. The bulkhead 66, for example, may include an annular combustor shell 164 and an annular combustor heat shield 166. The heat shield 166 may include one or more heat shield panels 168, which are arranged around the axis. One or more of the panels 168 may each sealingly engage an adjacent one of the panels 168 in an overlap joint similar to that described above. One or more of the panels 168 may also or alternatively sealingly engage an adjacent one of the panels 98 in an overlap joint 170. One or more of the panels 168, for example, each include a circumferentially extending flange 172 that is located radially between the respective panel 98 and the respective shell 82. This flange 172 may contact and be biased against the respective panel 98 to form a seal between the panels 168 and 98. In other embodiments, referring to FIG. 15, one or more of the panels 168 may each include a rail 174 that extends axially to the shell 164. An end portion of an adjacent panel 98 may overlap and contact the rail 174 to form a seal between the panels 168 and 98.

The terms "upstream", "downstream", "inner" and "outer" are used to orientate the components of the combustor 62 described above relative to the turbine engine 20 and its axis 22. A person of skill in the art will recognize, however, one or more of these components may be utilized in other orientations than those described above. The present invention therefore is not limited to any particular combustor spatial orientations.

The combustor 62 may be included in various turbine engines other than the one described above. The combustor 62, for example, may be included in a geared turbine engine where a gear train connects one or more shafts to one or more rotors in a fan section, a compressor section and/or any other engine section. Alternatively, the combustor 62 may be included in a turbine engine configured without a gear train. The combustor 62 may be included in a geared or non-geared turbine engine configured with a single spool, with two spools (e.g., see FIG. 1), or with more than two spools. The turbine engine may be configured as a turbofan engine, a turbojet engine, a propfan engine, or any other type of turbine engine. The present invention therefore is not limited to any particular types or configurations of turbine engines.

While various embodiments of the present invention have been disclosed, it will be apparent to those of ordinary skill in the art that many more embodiments and implementations are possible within the scope of the invention. For example, the present invention as described herein includes several aspects and embodiments that include particular features. Although these features may be described individually, it is within the scope of the present invention that some or all of these features may be combined within any one of the aspects and remain within the scope of the invention. Accordingly, the present invention is not to be restricted except in light of the attached claims and their equivalents.

What is claimed is:

1. A combustor wall at least partially defining a combustion chamber for a turbine engine, the combustor wall comprising:

a combustor shell; and a combustor heat shield attached to the combustor shell and positioned between the combustion chamber and the combustor shell, the combustor heat shield including a first panel and a second panel, the first panel and the second panel each having a respective inner surface positioned on a hot side of the combustor heat shield and a respective outer surface positioned on a cold side of the combustor heat shield, wherein a flange of the second panel sealingly engages with and radially contacts the outer surface of the first panel at an overlap joint to seal a gap between the first panel and the second panel, wherein the gap is defined between an end face of the first panel and an end face of the second panel, and wherein the flange of the second panel extends substantially parallel with the outer surface of the first panel at the overlap joint;

wherein a continuous cooling cavity extends between the combustor shell and the combustor heat shield, the continuous cooling cavity extends from the first panel, the second panel, and the overlap joint to the combustor shell, and the continuous cooling cavity fluidly couples a plurality of apertures in the combustor shell with a plurality of apertures in the combustor heat shield.

2. The combustor wall of claim 1, wherein the overlap joint comprises a joggle lap joint.

3. The combustor wall of claim 1, wherein the overlap joint comprises a double joggle lap joint.

4. The combustor wall of claim 1, wherein the second panel is mechanically biased against the first panel at the overlap joint.

5. The combustor wall of claim 1, wherein the second panel includes one or more cooling features located at the overlap joint within the continuous cooling cavity.

6. The combustor wall of claim 5, wherein one or more of the plurality of apertures in the combustor shell direct cooling air into the continuous cooling cavity to impinge against one or more of the one or more cooling features.

7. The combustor wall of claim 5, wherein a first of the one or more cooling features comprises a cooling pin.

8. The combustor wall of claim 1, wherein the combustor heat shield extends along an axis, and an axial end of the first panel engages an axial end of the second panel at the overlap joint.

9. The combustor wall of claim 1, wherein the combustor heat shield extends along an axis, the first and second panels are arcuate shaped, and a circumferential end of the first panel engages a circumferential end of the second panel at the overlap joint.

10. The combustor wall of claim 1, wherein a channel is defined by the gap between the first panel and the second panel at the overlap joint; and one or more of the plurality of apertures in the combustor heat shield extend through the second panel between the continuous cooling cavity and the channel.

11. The combustor wall of claim 1, wherein the combustor shell is configured to engage a combustor bulkhead at an upstream end of the combustor bulkhead.

12. A combustor for a turbine engine, the combustor comprising:

a tubular combustor shell extending along an axis;

a heat shield first panel attached to the tubular combustor shell and positioned between a combustion chamber and the tubular combustor shell, the heat shield first panel having an inner surface positioned on a hot side of the heat shield first panel and an outer surface positioned on a cold side of the heat shield first panel; and a heat shield second panel positioned between the combustion chamber and the tubular combustor shell, a flange of the heat shield second panel being sealingly engaged with and radially in contact with the outer surface of the heat shield first panel in an overlap joint to seal a gap between the heat shield first panel and the heat shield second panel, the heat shield second panel having an inner surface positioned on a hot side of the heat shield second panel and an outer surface positioned on a cold side of the heat shield second panel;

wherein the gap is defined between an end face of the heat shield first panel and an end face of the heat shield second panel, and wherein the flange of the heat shield second panel extends substantially parallel with the outer surface of the heat shield first panel at the overlap joint;

wherein the tubular combustor shell, the heat shield first panel and the heat shield second panel form a continuous cooling cavity that fluidly couples a plurality of apertures in the tubular combustor shell with a plurality of apertures in the heat shield first panel; and wherein the continuous cooling cavity extends from the heat shield first panel, the heat shield second panel, and the overlap joint to the tubular combustor shell.

13. The combustor of claim 12, further comprising:

a combustor first wall;

a combustor second wall including the tubular combustor shell, the heat shield first panel and the heat shield second panel; and a combustor bulkhead extending radially between the combustor first wall and the combustor second wall;

wherein the first wall, the second wall and the combustor bulkhead form the combustion chamber.

14. A combustor for a turbine engine, the combustor comprising:

a combustor shell extending along an axis;

a heat shield first panel attached to the combustor shell and positioned between a combustion chamber and the combustor shell, the heat shield first panel having an inner surface positioned on a hot side of the heat shield first panel and an outer surface positioned on a cold side of the heat shield first panel; and a heat shield second panel having a flange, the flange of the heat shield second panel sealingly engaged with and radially contacting the outer surface of the heat shield first panel in an overlap joint to seal a gap between the heat shield first panel and the heat shield second panel, the heat shield second panel being positioned between the combustion chamber and the combustor shell and having an inner surface positioned on a hot side of the heat shield second panel and an outer surface positioned on a cold side of the heat shield second panel;

wherein the gap is defined between an end face of the heat shield first panel and an end face of the heat shield second panel, and wherein the flange of the heat shield second panel extends substantially parallel with the outer surface of the heat shield first panel at the overlap joint;

wherein a portion of the heat shield second panel is radially between the combustor shell and the heat shield first panel;

wherein a continuous cooling cavity fluidly couples a plurality of apertures in the combustor shell with a plurality of apertures in the heat shield first panel; and wherein the continuous cooling cavity extends from the heat shield first panel, the heat shield second panel, and the overlap joint to the combustor shell.

15. A combustor for a turbine engine, the combustor comprising:

a combustor first wall;

a combustor second wall comprising a tubular combustor shell extending along an axis and a heat shield first panel attached to the tubular combustor shell; and a combustor bulkhead including extending radially between the combustor first wall and the combustor second wall, and the combustor bulkhead comprising a heat shield second panel sealingly engaged with the heat shield first panel in an overlap joint;

wherein the tubular combustor shell, the heat shield first panel and the heat shield second panel at least partially form a cooling cavity that fluidly couples a plurality of apertures in the tubular combustor shell with a plurality of apertures in the heat shield first panel; and wherein the combustor first wall, the combustor second wall and the combustor bulkhead form a combustion chamber.

16. The combustor of claim 15, wherein the combustor bulkhead further includes an annular shell;

the heat shield second panel is attached to the annular shell; and the cooling cavity extends axially between the annular shell and the heat shield second panel.

* * * * *